US009279306B2

(12) United States Patent
Baihly

(10) Patent No.: US 9,279,306 B2
(45) Date of Patent: Mar. 8, 2016

(54) PERFORMING MULTI-STAGE WELL OPERATIONS

(75) Inventor: Jason Baihly, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 801 days.

(21) Appl. No.: 13/347,991

(22) Filed: Jan. 11, 2012

(65) Prior Publication Data

US 2013/0175052 A1 Jul. 11, 2013

(51) Int. Cl.

| | |
|---|---|
| ***E21B 29/02*** | (2006.01) |
| ***E21B 43/28*** | (2006.01) |
| ***E21B 33/134*** | (2006.01) |
| ***E21B 43/14*** | (2006.01) |
| ***E21B 43/26*** | (2006.01) |

(52) U.S. Cl.

CPC ..... *E21B 33/134* (2013.01); *E21B 43/14* (2013.01); *E21B 43/261* (2013.01)

(58) Field of Classification Search

CPC ..... E21B 29/02; E21B 43/28
USPC ..... 166/192, 376, 308.1
See application file for complete search history.

(56) References Cited

U.S. PATENT DOCUMENTS

| | | | |
|---|---|---|---|
| 3,011,548 | A | 12/1961 | Holt |
| 3,054,415 | A | 9/1962 | Baker et al. |
| 3,263,752 | A | 8/1966 | Conrad |
| 3,269,463 | A | 8/1966 | Page, Jr. |
| 3,995,692 | A | 12/1976 | Seitz |
| 4,064,937 | A | 12/1977 | Barrington |
| 4,355,686 | A | 10/1982 | Arendt |
| 4,729,432 | A | 3/1988 | Helms |
| 4,771,831 | A | 9/1988 | Pringle et al. |
| 5,183,114 | A | 2/1993 | Mashaw, Jr. et al. |
| 5,224,044 | A | 6/1993 | Tamura et al. |
| 5,295,393 | A | 3/1994 | Thiercelin |
| 5,333,692 | A | 8/1994 | Baugh et al. |
| 5,526,888 | A | 6/1996 | Gazewood |

(Continued)

FOREIGN PATENT DOCUMENTS

| | | | |
|---|---|---|---|
| WO | 03095794 | A1 | 11/2003 |
| WO | 2004088091 | A1 | 10/2004 |

OTHER PUBLICATIONS

Thomson, D. W., and Nazroo, M. F., Design and Installation of a Cost-Effective Completion System for Horizontal Chalk Wells Where Multiple Zones Require Acid Stimulation, SPE 51177 (a revision of SPE 39150), Offshore Technology Conference, May 1997, Houston, TX, USA.

(Continued)

*Primary Examiner* — Catherine Loikith
(74) *Attorney, Agent, or Firm* — Jeffery R. Peterson

(57) ABSTRACT

Plugs are deployed along a wellbore to form fluid barriers for associated stages. The plugs include a first plug that includes a first material that reacts with a first agent and does not react with a second agent and a second plug that includes a second material that reacts with the second agent and does not react with the first agent. A first stimulation operation is performed in the stage that is associated with the first plug; and a first agent is communicated into the well to react with the first material to remove the first plug. A second stimulation operation is performed in the stage that is associated with the second plug. The second agent is communicated into the well to react with the second material to remove the second plug.

20 Claims, 6 Drawing Sheets

(56) References Cited

U.S. PATENT DOCUMENTS

| | | | | |
|---|---|---|---|---|
| 5,921,318 | A | 7/1999 | Ross | |
| 5,988,285 | A | 11/1999 | Tucker et al. | |
| 6,006,838 | A | 12/1999 | Whiteley et al. | |
| 6,059,032 | A | 5/2000 | Jones | |
| 6,155,342 | A | 12/2000 | Oneal et al. | |
| 6,206,095 | B1 | 3/2001 | Baugh | |
| 6,216,785 | B1 | 4/2001 | Achee, Jr. et al. | |
| 6,302,199 | B1 | 10/2001 | Hawkins et al. | |
| 6,334,486 | B1 | 1/2002 | Carmody et al. | |
| 6,371,208 | B1 | 4/2002 | Norman et al. | |
| 6,443,228 | B1 | 9/2002 | Aronstam et al. | |
| 6,543,538 | B2 | 4/2003 | Tolman et al. | |
| 6,634,429 | B2 | 10/2003 | Henderson et al. | |
| 6,907,936 | B2 | 6/2005 | Fehr et al. | |
| 6,997,263 | B2 | 2/2006 | Campbell et al. | |
| 7,066,265 | B2 | 6/2006 | Surjaatmadja | |
| 7,093,664 | B2 | 8/2006 | Todd et al. | |
| 7,108,067 | B2 | 9/2006 | Themig et al. | |
| 7,134,505 | B2 | 11/2006 | Fehr et al. | |
| 7,168,494 | B2 | 1/2007 | Starr et al. | |
| 7,210,533 | B2 | 5/2007 | Starr et al. | |
| 7,322,417 | B2 | 1/2008 | Rytlewski et al. | |
| 7,325,617 | B2 | 2/2008 | Murray | |
| 7,353,879 | B2 | 4/2008 | Todd et al. | |
| 7,377,321 | B2 | 5/2008 | Rytlewski | |
| 7,387,165 | B2 | 6/2008 | Lopez de Cardenas et al. | |
| 7,431,091 | B2 | 10/2008 | Themig et al. | |
| 7,451,815 | B2 * | 11/2008 | Hailey, Jr. | 166/278 |
| 7,464,764 | B2 | 12/2008 | Xu | |
| 7,490,669 | B2 | 2/2009 | Walker et al. | |
| 7,543,634 | B2 | 6/2009 | Fehr et al. | |
| 7,543,647 | B2 | 6/2009 | Walker | |
| 7,552,779 | B2 | 6/2009 | Murray | |
| 7,571,765 | B2 | 8/2009 | Themig | |
| 7,575,062 | B2 | 8/2009 | East, Jr. | |
| 7,661,481 | B2 | 2/2010 | Todd et al. | |
| 7,748,460 | B2 | 7/2010 | Themig et al. | |
| 7,832,472 | B2 | 11/2010 | Themig | |
| 7,891,774 | B2 | 2/2011 | Silverbrook | |
| 2002/0007949 | A1 * | 1/2002 | Tolman et al. | 166/280 |
| 2003/0180094 | A1 | 9/2003 | Madison | |
| 2004/0118564 | A1 | 6/2004 | Themig et al. | |
| 2004/0140094 | A1 | 7/2004 | Todd | |
| 2004/0262016 | A1 | 12/2004 | Farquhar | |
| 2006/0124310 | A1 | 6/2006 | Lopez de Cardenas et al. | |
| 2006/0207764 | A1 | 9/2006 | Rytlewski | |
| 2006/0243455 | A1 | 11/2006 | Telfer et al. | |
| 2007/0044958 | A1 | 3/2007 | Rytlewski et al. | |
| 2007/0107908 | A1 | 5/2007 | Vaidya et al. | |
| 2007/0181224 | A1 | 8/2007 | Marya et al. | |
| 2007/0272413 | A1 | 11/2007 | Rytlewski et al. | |
| 2007/0284097 | A1 | 12/2007 | Swor et al. | |
| 2008/0105438 | A1 | 5/2008 | Jordan et al. | |
| 2008/0110622 | A1 | 5/2008 | Willett | |
| 2008/0210429 | A1 | 9/2008 | McMillin et al. | |
| 2008/0289823 | A1 | 11/2008 | Willberg | |
| 2010/0101803 | A1 | 4/2010 | Clayton et al. | |
| 2010/0132954 | A1 | 6/2010 | Telfer | |
| 2010/0209288 | A1 | 8/2010 | Marya | |
| 2011/0056692 | A1 | 3/2011 | Lopez de Cardenas et al. | |
| 2011/0127047 | A1 | 6/2011 | Themig et al. | |
| 2011/0220361 | A1 | 9/2011 | Huang | |
| 2011/0220362 | A1 | 9/2011 | Huang | |
| 2011/0278010 | A1 | 11/2011 | Fehr et al. | |
| 2012/0085538 | A1 | 4/2012 | Guerrero et al. | |

OTHER PUBLICATIONS

Lonnes, S. B., Nygaard, K. J., Sorem, W. A., Hall, T. J., Tolman, R. C., Advanced Multizone Stimulation Technology, SPE 95778, Presented at the 2005 SPE Annual Technical Conference and Exhibition, Oct. 9-12, 2005, Dallas, TX, USA.

Rytlewski, G., Multiple-Layer Commpletions for Efficient Treatment of Multilayer Reservoirs, IADC/SPE 112476, Presented at the 2008 IADC/SPE Drilling Conference, Mar. 4-6, 2008, Orlando, FL, USA.

* cited by examiner

PERFORMING MULTI-STAGE WELL OPERATIONS

BACKGROUND

For purposes of preparing a well for the production of oil or gas, at least one perforating gun may be run into the well via a deployment mechanism, such as a wireline or a coiled tubing string. The shaped charges of the perforating gun(s) are fired when the gun(s) are appropriately positioned to perforate a casing of the well and form perforating tunnels into the surrounding formation. One or more stimulation operations (a hydraulic fracturing, for example) may be performed in the well to increase the well's permeability. These operations may be multiple stage operations, which may involve several runs, or trips, into the well.

SUMMARY

In an embodiment, plugs are deployed along a wellbore to form fluid barriers for associated stages. The plugs include a first plug that includes a first material that reacts with a first agent and does not react with a second agent and a second plug that includes a second material that reacts with the second agent and does not react with the first agent. A first stimulation operation is performed in the stage that is associated with the first plug; and a first agent is communicated into the well to react with the first material to remove the first plug. A second stimulation operation is performed in the stage that is associated with the second plug. The second agent is communicated into the well to react with the second material to remove the second plug.

DETAILED DESCRIPTION

Figure 1:
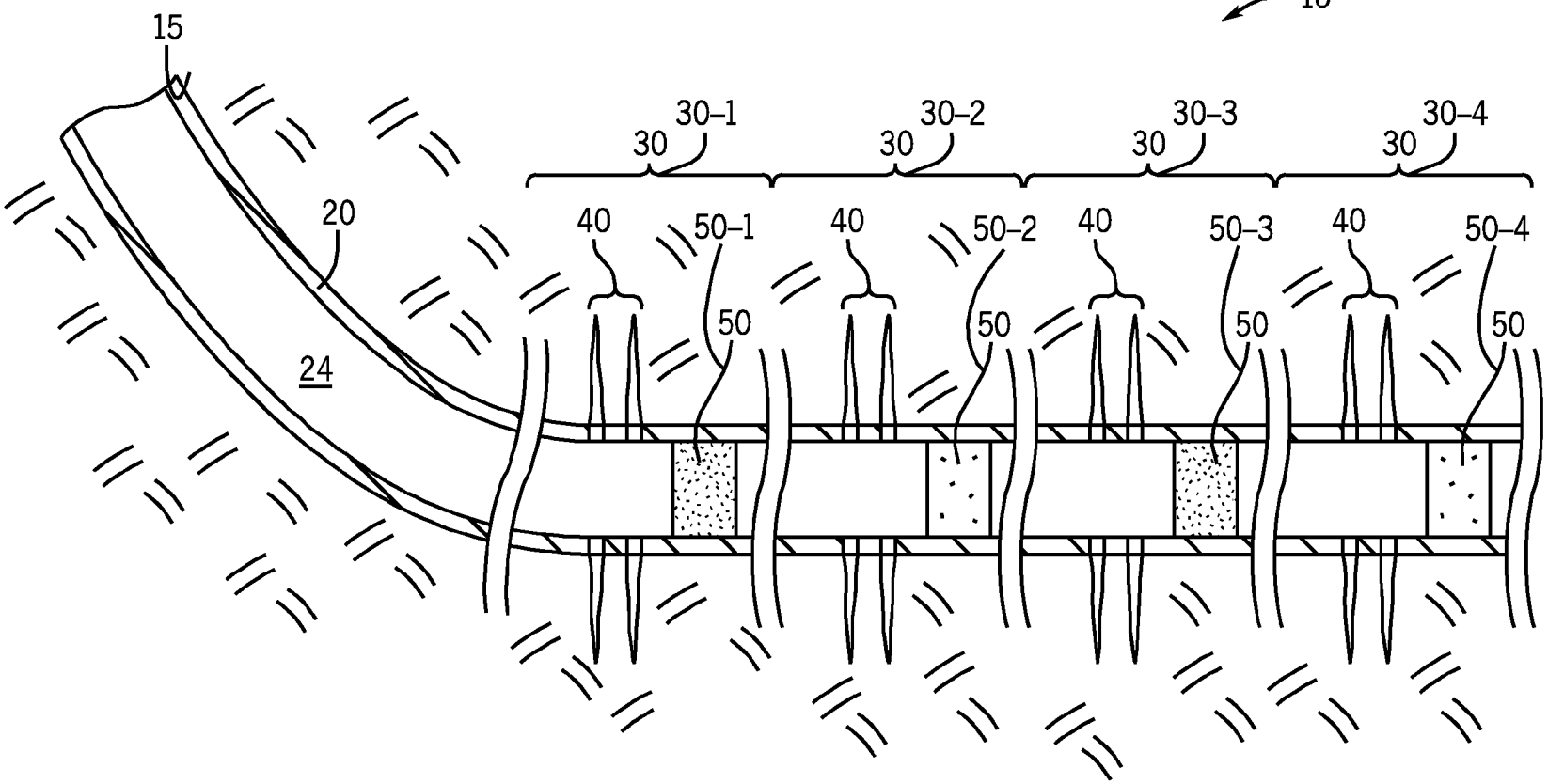
FIGS. 1, 2, 3 and 6 are schematic diagrams illustrating multi-stage stimulation operations according to some embodiments.

In the following description, numerous details are set forth to provide an understanding of features of various embodiments. However, it will be understood by those skilled in the art that the subject matter that is set forth in the claims may be practiced without these details and that numerous variations or modifications from the described embodiments are possible.

As used herein, terms, such as "up" and "down"; "upper" and "lower"; "upwardly" and downwardly"; "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationships as appropriate. Likewise, when applied to equipment and methods for use in environments that are vertical, such terms may refer to lower to upper, or upper to lower, or other relationships as appropriate.

In general, systems and techniques are disclosed herein for purposes of performing multiple stage (or "multi-stage") stimulation operations (fracturing operations, acidizing operation, etc.) in multiple zones, or stages, of a well using plugs that are constructed to form fluid tight barriers (also called "fluid barriers" herein) in the well. Before the stimulation operations commence, the plugs may be installed at predetermined positions along a wellbore (inside a tubular string that extends in the wellbore, for example) to create fluid barriers for associated isolated zones, or stages. More particularly, each plug may form the lower boundary of an associated stage; and after the plugs are installed, the stimulation operations proceed in heel-to-toe fashion (i.e., in a direction moving downhole) along the wellbore. In this manner for a given stage, a stimulation operation is performed in the stage and then the associated plug at the downhole end of the stage is removed to allow access to the next stage for purposes of performing the next stimulation operation.

Reactive agents are introduced into the well to selectively remove the plugs as the stimulation operations progress downhole. For this purpose, alternate materials are used for the plugs: some of the plugs contain a material (called "material A" herein) that is degradable (dissolvable, for example) using a particular reactive agent (called "agent A" herein); and some of the plugs contain another material (called "material B" herein) that is degradable using another reactive agent (called "agent B" herein). Material A does not react or degrade in the presence of agent B, and likewise, material B does not react or degrade in the presence of agent A. Plugs containing the A and B materials are alternated in an ordered spatial sequence along the wellbore, which prevents the reactive agent that is used to dissolve the material of one plug in a given stage from dissolving the material of another plug in the adjacent stage.

For example, when the stimulation operation for a given stage is complete, a reactive agent (agent A, for example) may be introduced into the stage to remove the associated plug (having material A, for example) for purposes of allowing access to the next stage. Because the plug in the next stage is made from a material (material B, for example) that does not react with the reactive agent (agent A, for example), the integrity of this plug is preserved, thereby allowing the stimulation operation in the next stage to rely on the fluid barrier provided by this plug.

Referring to FIG. 1, as a more specific non-limiting example, in accordance with some embodiments, a well 10 includes a wellbore 15, which traverses one or more producing formations. In general, the wellbore 15 extends through one or multiple zones, or stages 30 (four stages 30-1, 30-2, 30-3 and 30-4 being depicted in FIG. 1, as non-limiting examples) of the well 10. The wellbore 15 may be lined, or supported, by a tubular string 20, as depicted in FIG. 1, and the tubular string 20 may be cemented to the wellbore 15 (such wellbores are typically referred to as "cased hole" wellbores, as the string 20 serves as a casing string to line and support the well). In further embodiments, the tubular string 20 may be secured to the formation by packers (such wellbores are typically referred to as "open hole" wellbores). For these embodiments, the tubular string 20 serves as a tubing string (a production tubing string or an injection tubing string, as non-limiting examples).

It is noted that although FIG. 1 and the subsequent figures depict a lateral wellbore 15, the techniques and systems that are disclosed herein may likewise be applied to vertical wellbores. Moreover, in accordance with some embodiments, the well 10 may contain multiple wellbores, which contain tubing strings that are similar to the illustrated tubular string 20. Thus, many variations are contemplated and are within the scope of the appended claims.

In the following non-limiting examples, it is assumed that the stimulation operations are conducted in a direction from the heel end to the toe end of the wellbore 15. Moreover, for the following non-limiting examples, it is assumed that operations may have been conducted in the well prior to the beginning of the stimulation operations to enhance fluid communication with the surrounding reservoir.

One way to enhance fluid communication with the surrounding reservoir is by running one or more perforating guns into the tubular string 20 (on a coiled tubular string or wireline, as non-limiting examples) before any plugs have been installed in the tubular string 20. In general, a perforating gun includes shaped charges that, when the perforating gun is fired, form perforating jets that pierce the wall of the tubular string 20 and forms perforation tunnels that extend into the surrounding reservoir. The figures depict sets 40 of perforation tunnels that are formed in each stage 30 (through one or more previous perforating operations) and extend through the tubular string 20 into the surrounding formation(s). It is noted that each stage 30 may have multiple sets of perforation tunnels 40.

Using a perforating gun is merely an example of one way to establish/enhance fluid communication with the reservoir, as the fluid communication may be established/enhanced through any of a number of techniques. For example, an abrasive slurry communication tool may be run downhole inside the tubular string 20 on a coiled tubing string and used to communicate an abrasive slurry in a jetting operation to selectively abrade the wall of the tubular string 20. As another example, the tubular string 20 may have sliding sleeve valves that are opened for purposes of opening fluid communication with the surrounding formation for the stimulation operations, as discussed further below in connection with FIG. 6.

For the example that is depicted in FIG. 1, after perforating operations have been performed to create the perforation tunnels 40, plugs 50 (plugs 50-1, 50-2, 50-3 and 50-4, being depicted in FIG. 1, as non-limiting examples), also called "bridge plugs," may be deployed in the tubular string 20 at desired depths for creating the respective fluid barriers for associated stages 30. In this manner, each stage 30 has an associated plug 50 that forms a fluid barrier, which establishes a lower boundary of the stage 30. For example, the plug 50-1 forms a lower boundary for the stage 30-1.

In some embodiments, the plugs 50 may be run into the tubular string 20 in one or more trips using a plug setting tool that carries and sets multiple plugs or using a plug setting tool that carriers and sets one plug at a time. The plug setting tool may be run downhole on conveyance line, such as a coiled tubing string, a wireline or a slickline, depending on the particular embodiment. In further embodiments, the plugs may be pumped downhole without the use of a conveyance line. In further embodiments, the plugs 50 may be placed in the tubular string 20 at the Earth surface, as the string 20 is being installed.

Regardless of the conveyance mechanism, tool used, or deployment technique in general, the plugs 50 are set in a sequence from the toe end to the heel end of the wellbore 15. Thus, for the example that is depicted in FIG. 1, the plug 50-4 is set at the appropriate depth before the plugs 50-3, 50-2 and 50-1; the plug 50-3 is next set at the appropriate depth before the plugs 50-2 and 50-1; and so forth.

The plug 50 may have one of numerous forms, depending on the particular embodiment. For example, in some embodiments, the plug 50 may have a resilient outer sealing element that is expanded by the plug setting tool and an interior sealing element that forms the remaining seal for the plug 50. The outer sealing element, the interior sealing element or both sealing elements may form the material that is dissolved by introduction of the appropriate agent into the associated stage 30. As another example, the plug 50 may be a solid material that is dissolved by the introduction of the appropriate agent into the associated stage 30. In this manner, a given plug 50 may, in accordance with some embodiments, be formed by setting a first smaller bridge plug at a predetermined position in the tubular string 20 and then communicating material into the well, which deposits on the first plug to form the plug 50. As another example, the plug 50 may contain an expandable sealing element that is a composite material that contains a material that dissolves in the presence of the appropriate agent. As another example, the plug 50 contains a setting/setting retention mechanism that contains a material that dissolves in the presence of the appropriate agent to cause the plug 50 to lose its seal.

Regardless of the particular form of the plug 50, the plug 50 contains a material that is constructed to degrade (dissolve, for example) in the presence of a certain reactive agent for purposes of removing the fluid barrier that is created by the plug 50. Thus, although FIGS. 1, 2, 3 and 6 schematically represent the plug 50 as being formed from a solid material, it is understood that the techniques and systems that are disclosed herein apply to other types of plugs and in general, are directed to the use of a plug that contain a material that degrades in the presence of a certain agent for purposes of removing the fluid barrier created by the plug.

Although FIG. 1 depicts the plugs 50 are being set inside the tubular string 20, the plugs 50 may be deployed to form fluid barriers against an uncased wellbore wall in further embodiments. Thus, in general, the plugs 50 are set along a wellbore, with the plugs 50 being set inside a tubing string or against the wellbore wall, depending on the particular embodiment.

For the following examples, it is assumed that each plug 50 contains one of two materials: a material A that dissolves in the presence of a reactive agent A and does not react or dissolve in the presence of another reactive agent B; and material B that dissolves in the presence of agent B but does not react or dissolve in the presence of agent A. The deployment of the plugs 30 into the tubular string 20 follows an ordered spatial sequence: the plugs associated with odd indices (plugs 50-1 and 50-3, for the example depicted in FIG. 1) of the sequence contain material A (and do not contain material B); and the plugs associated with the even indices (plugs 50-2 and 50-4, for the examples depicted in FIG. 1) of the sequence contain material B (and do not contain material A). Thus, in general, the presence of agent A does not compromise the integrity of the plugs 50-2 and 50-4; and the presence of agent B does not compromise the integrity of the plugs 50-1 and 50-3.

It is noted that although for the following examples, it is assumed that the plugs 50 contain two different types of material, more than two types of plugs 50, which contain more than two types of material that are selectively dissolvable using different agents may be used, in accordance with other implementations.

Due to the alternating deployment of the materials A and B, a plug 50 uphole from a lower stage 30 may be removed using an agent, which does not react with the plug 50 that forms the downhole boundary for the lower stage 30. Thus, due to the plugs 50 containing alternating materials A and B, stimulation operations may be performed by first deploying all of the plugs 50 in the well in the above-described alternating fashion and then alternating the use of the agents A and B for purposes of selectively removing the plugs 50 as the stimulation operations proceed downhole.

Turning now to a more specific example, it is assumed, as depicted in FIG. 1, that perforating operations have already been performed prior to the running of the plugs 50 into the tubular string 20 to form the corresponding sets 40 of perforation tunnels into the surrounding formation/reservoir to enhance fluid communication with the stages 30. Moreover, as depicted in FIG. 1, it is assumed that before the stimulation operations commence, the plugs 50 have been run and set inside the central passageway 24 of the tubular string 20. A stimulation operation is first performed in the heel most stage, such as stage 30-1 (for the example depicted in FIG. 1), using the fluid tight barrier that is provided by the plug 50-1.

Assuming, for a non-limiting example, that the stimulation operation that is performed in the stage 30-1 is a hydraulic fracturing operation, fracturing fluid is pumped from the Earth surface into the tubular string 20 and the plug 50-1 diverts the fracturing fluid into the perforating tunnels 40 of the stage 30-1. The fracturing operation in the stage 30-1 results in the formation of a corresponding fractured region 60. It is noted that a stimulation operation other than a fracturing operation may be performed, in accordance with other embodiments.

Figure 2:
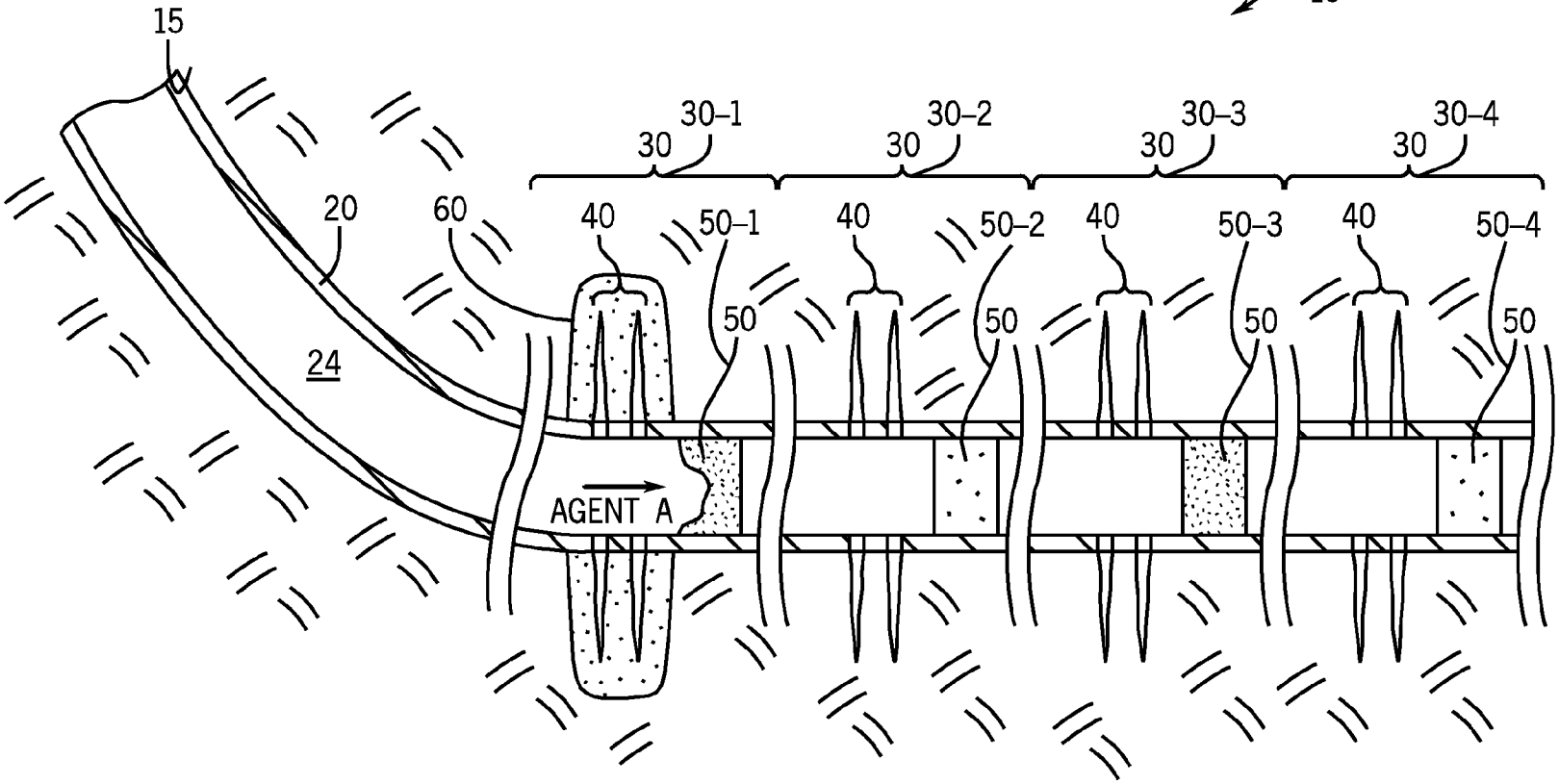

After the stimulation operation is complete in the stage 30-1 or near the time when the stimulation operation is to be completed, agent A is introduced into the well from the Earth surface and enters the stage 30-1, where agent A begins dissolving material A of the plug 50-1, as depicted in FIG. 2. In this regard, the agent A may either dissolve or substantially weaken the material A of plug 50-1, which facilitates the removal of the plug 50-1. Before the fluid barrier that is provided by plug 50-1 is removed, a hydraulic communication inhibiting agent, such as ball sealers or fibers, may be pumped into the stage 30-1 from the Earth surface for purposes of sealing off reservoir communication through the perforating tunnels 40 associated with the stage 30-1.

Figure 3:
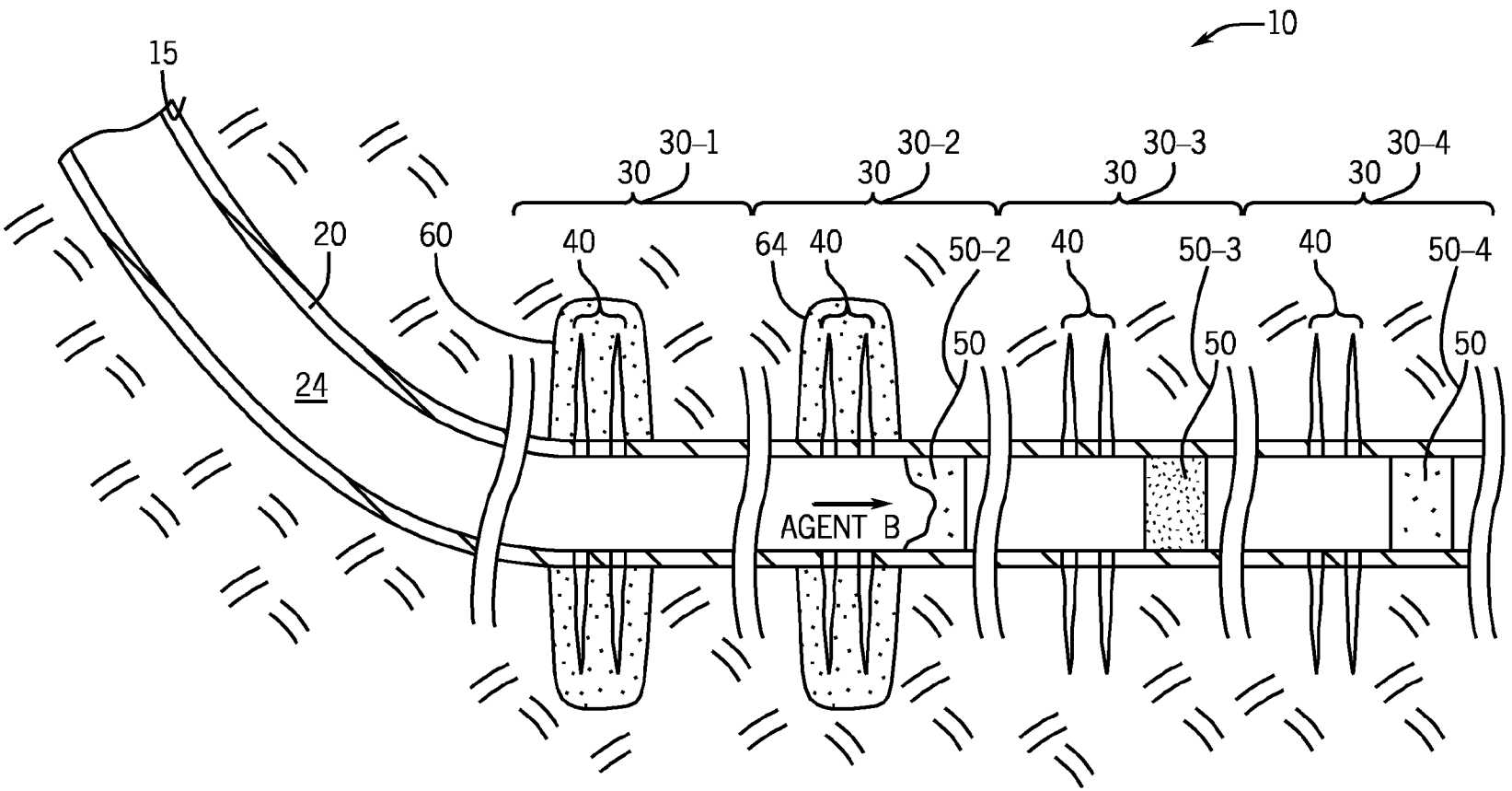

With the removal of the plug 50-1 and the sealing off of reservoir communication for the stage 30-1, a stimulation operation may then begin in the next stage 30-2, which results in a corresponding fractured region 64 that is depicted in FIG. 3. Due to the volume of fracturing fluid that is pumped into the stage 30-2 during this next stimulation operation, agent A is significantly diluted and/or pumped into the formation that surrounds stage 30-2. Therefore, at the conclusion of the stimulation operation for the stage 30-2, the concentration of remaining agent A in the tubular string 20 is substantially small enough not to react with the material A of plug 50-3 when the plug 50-2 is removed. Therefore, the plug 50-3 is not removed until another volume of agent A is pumped into the stage 30-3.

FIG. 3 depicts the subsequent introduction of agent B at or near the conclusion of this second stimulation operation for purposes of removing the plug 50-2. While the plug 50-2 still provides a fluid tight barrier, a hydraulic communication agent may be pumped in the stage 30-2 to seal off communication through the perforation tunnels 40 associated with the stage 30-2.

Stimulation operations may be performed in the additional stages 30 (such as stage 30-3 and 30-4, as non-limiting examples) in a similar manner by alternating the reactive agents that are introduced for purposes of removing the plug 50s. Thus, plug 50-3 is removed using agent A, the plug 50-4 is removed using agent B, and so forth.

As non-limiting examples, in accordance with some embodiments, material A may be calcium carbonate, which dissolves in the presence of an acid (hydrochloric acid, for example), which forms agent A; and material B may be a polyacrylic polymer, which dissolves in the presence of a base (sodium hydroxide, calcium hydroxide, magnesium hydroxide, etc., as non-limiting examples), which forms agent B. For this example, it is noted that the calcium carbonate material does not dissolve in the presence of a base, and the polyacrylic polymer material does not dissolve in the presence of an acid.

Figure 4:
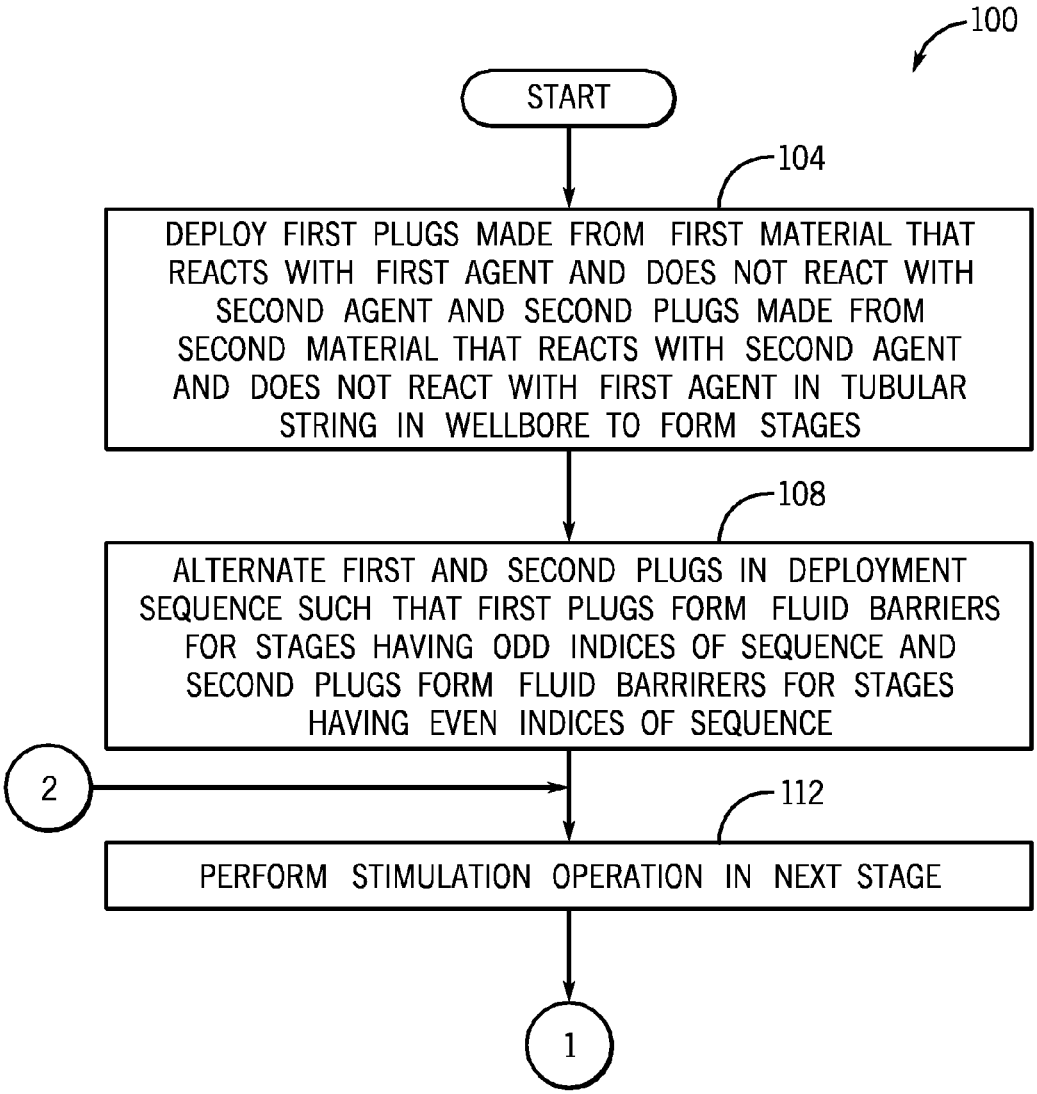
FIGS. 4 and 5 illustrate a technique to perform multi-stage stimulation operations according to some embodiments.
Figure 5:
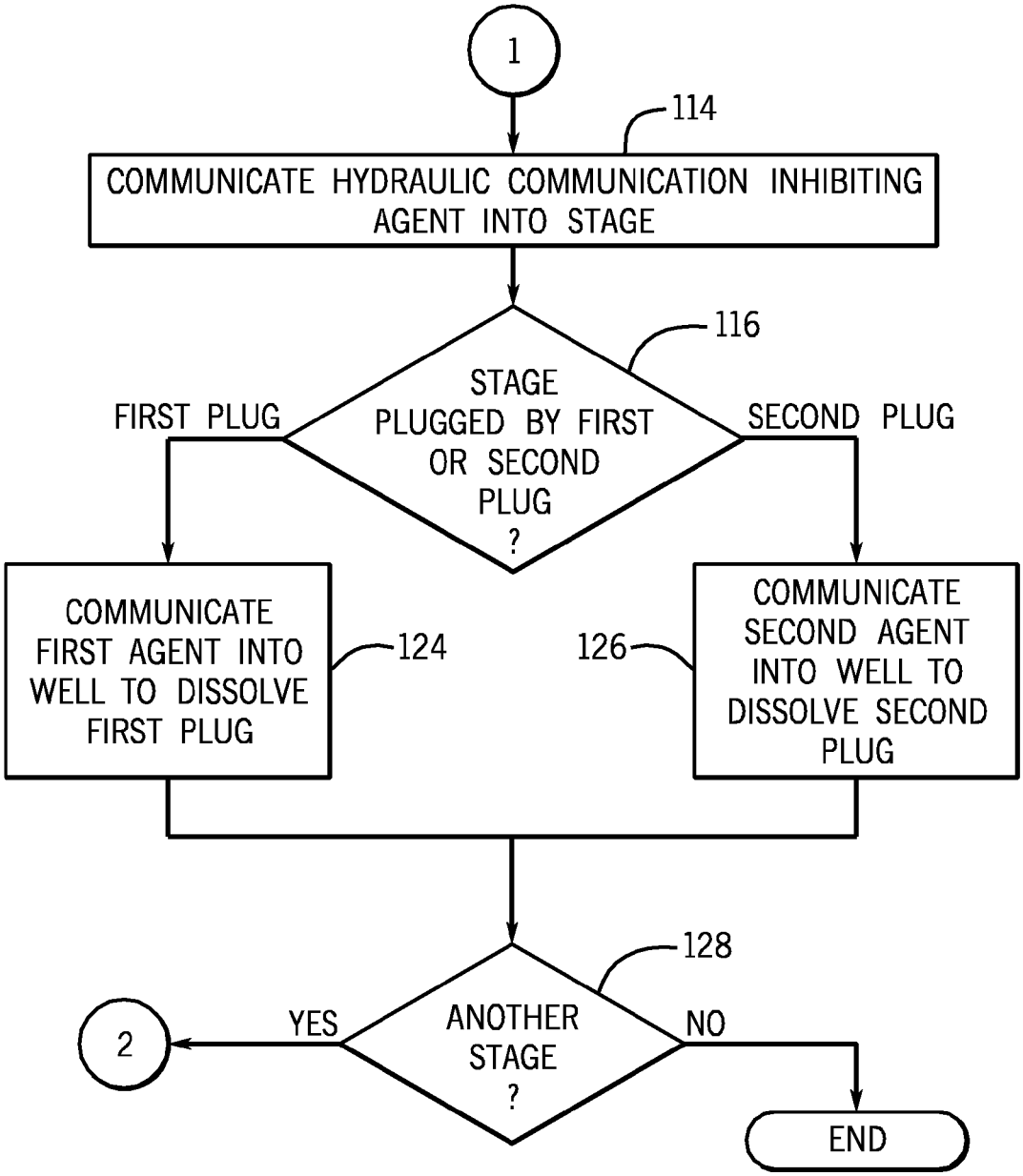

Referring to FIGS. 4 and 5, to summarize, a technique 100 in accordance with embodiments includes deploying (block 104) first plugs that are made from a first material that reacts with a first agent and does not react with a second agent and second plugs that are made from a second material that does not react with the first agent and reacts with the second agent in a wellbore to form isolated stages. The technique 100 includes alternating the first and second plugs in a deployment sequence such that the first plugs form fluid barriers for the stages having odd indices of sequence and the second plugs form even indexes of the sequence, pursuant to block 108. After the deployment of the plugs, stimulation operations may then begin, pursuant to block 112.

Referring to FIG. 5, before the end of the completion operation, a hydraulic communication inhibiting agent is communicated in the stage, pursuant to block 114 and then a determination is made (decision block 116) whether a first plug (made from material A) or a second plug (made from material B) forms the lower boundary for the current stage. If the first forms the lower boundary, then the first agent is communicated into the well to remove the first plug, pursuant to block 124. If the second plug forms the lower boundary, then the second agent is communicated into the well to remove the second plug, pursuant to block 126. If a determination is made (decision block 128) that a completion operation is to be performed in another stage, then control returns to block 112.

Other variations are contemplated and are within the scope of the appended claims. For example, referring to FIG. 6, in accordance with other embodiments, a system that is depicted in a well 200 of Fig. may be used. Unlike the tubular string 20 that is depicted in FIGS. 1-3, the well 200 includes a tubing string 207, which has valves 205 (valves 205-1, 205-2, 205-03 and 205-4, which are depicted in FIG. 6 as non-limiting examples), which are selectively opened and closed for purposes of establishing reservoir communication for a given stage 30.

It is noted that although FIG. 5 depicts one valve 205 per stage 30, a given stage 30 may include multiple valves 205, in accordance with other implementations. In general, in accordance with some embodiments, the valve 205 may be a sleeve-type valve, which contains an inner sleeve 212 that may be operated (via a shifting tool, as a non-limiting example) for purposes of selectively opening and closing communication through radial ports 210 of the string 207.

Figure 6:
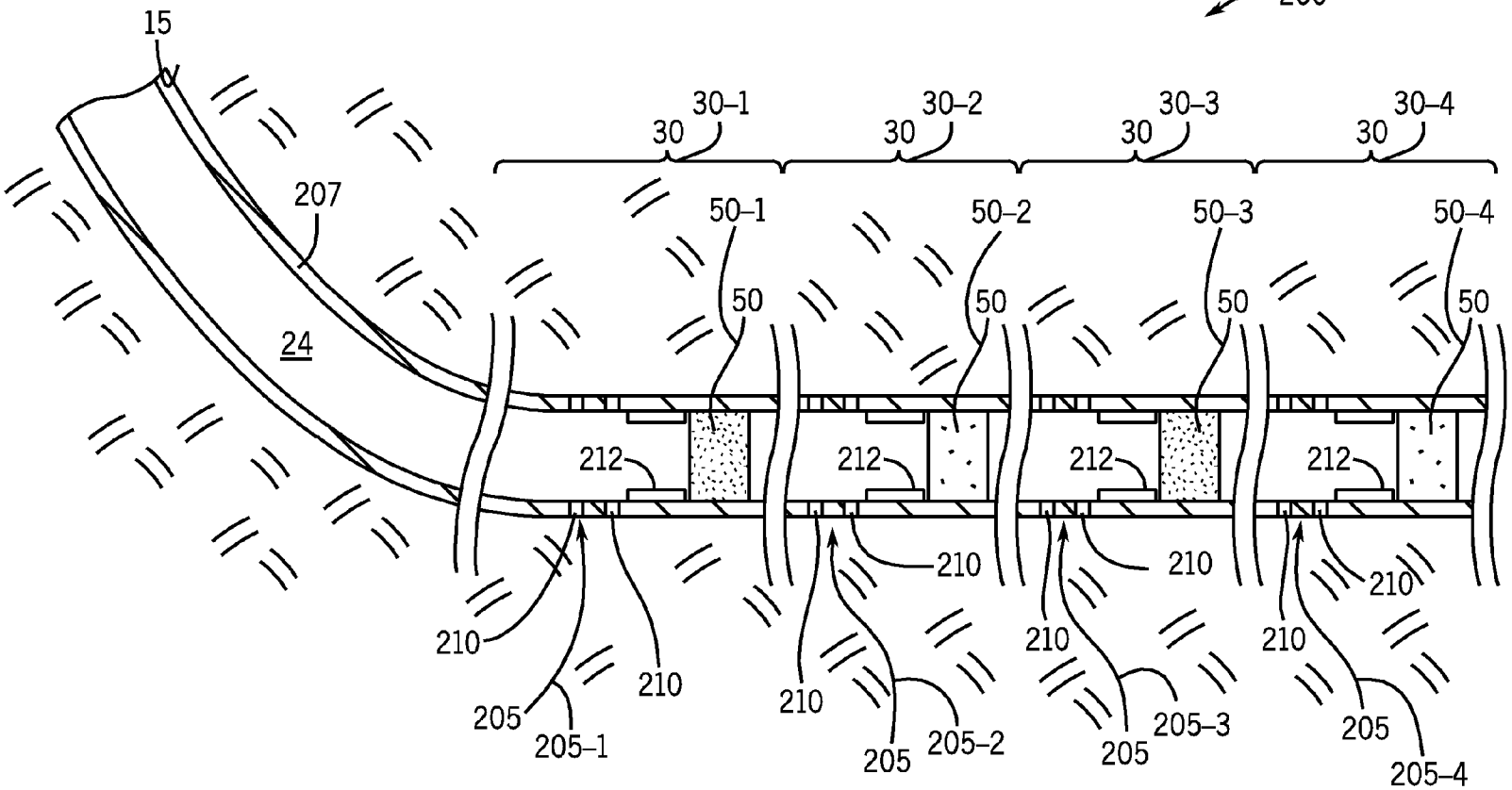

FIG. 6 generally depicts an initial state before the stimulation operations begin, in which all of the valves 205 are open, i.e., are in a stage in which fluid communication between the reservoir and the central passageway 24 of the string 204 occurs. When the stimulation operation in a given stage 30 is completed, the associated valve 205 is closed to prevent further communication for that stage 30 through the valve 205.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method usable with a well, comprising:

deploying plugs along a wellbore to form a plurality of fluid barriers for associated stages, the plugs comprising a first plug that comprises a first material that reacts with a first agent and does not react with a second agent and a second plug that comprises a second material that reacts with the second agent and does not react with the first agent, wherein each plug forms a lower boundary of its associated stage;

performing a first stimulation operation in the stage associated with the first plug;

communicating the first agent into the well to react with the first material to remove the first plug;

performing a second stimulation operation in the stage associated with the second plug; and communicating the second agent into the well to react with the second material to remove the second plug.

2. The method of claim 1, wherein the deploying comprises deploying the first plug and the second plug in a tubular string.

3. The method of claim 1, wherein the deploying comprises deploying the first plug and the second plug to form seals against a wall of the wellbore.

4. The method of claim 1, wherein the act of deploying the plugs comprises:

deploying a plurality of the first plugs and a plurality of the second plugs; and alternating the first plugs with the second plugs along the wellbore.

5. The method of claim 1, wherein the communicating the first agent comprises communicating the first agent in a fluid used in the first stimulation operation.

6. The method of claim 1, further comprising:

perforating the well to form perforation tunnels along the wellbore in the stages.

7. The method of claim 1, further comprising:

communicating a hydraulic communication inhibiting agent into the stage associated with the first plug at or near the conclusion of the first stimulation operation.

8. The method of claim 1, wherein the first agent comprises an acid, the first material comprises calcium carbonate, the second agent comprises a base, and the second plug comprises a polyacrylic polymer.

9. A method usable with a well, comprising:

deploying plugs along a wellbore to form a plurality of fluid barriers for associated stages, the plugs comprising a first plug that comprises a first material that reacts with a first agent and does not react with a second agent and a second plug that comprises a second material that reacts with the second agent and does not react with the first agent;

performing a first stimulation operation in the stage associated with the first plug;

communicating the first agent into the well to react with the first material to remove the first plug;

performing a second stimulation operation in the stage associated with the second plug;

communicating the second agent into the well to react with the second material to remove the second plug using a string-deployed valve in the isolated stage to allow formation communication in association with the first stimulation operation; and closing the valve at the conclusion of the first stimulation operation.

10. A system usable with a well, comprising:

a plurality of first plugs deployed in a wellbore, each of the first plugs comprising a first material being reactive with a first agent and not being reactive with a second agent;

a plurality of second plugs deployed in the wellbore, each of the second plugs comprising a second material being reactive with the second agent and not being reactive with the first agent;

wherein the first and second plugs form fluid barriers for a plurality of isolated stages in the well, each of the first and second plugs defining a lower boundary of an associated stage.

11. The system of claim 10, further comprising:

a tubing string, wherein the plurality of first plugs and the plurality of second plugs are deployed in a passageway of the tubing string.

12. The system of claim 10, wherein the plurality of first plugs and the plurality of second plugs form seals against a wall of the wellbore.

13. The system of claim 10, further comprising:

a tubing string comprising valves and a passageway, wherein the plurality of first plugs and the plurality of second plugs are deployed in the passageway of the tubing string, wherein at least one of the valves is adapted to be opened to permit fluid communication between the passageway of the tubing string and a region outside of the tubing string.

14. The system of claim 10, wherein the first agent comprises an acid, the first material comprises calcium carbonate, the second agent comprises a base, and the second material comprises a polyacrylic polymer.

15. A method usable with a well, comprising:

deploying plugs in a wellbore to form fluid barriers for a plurality of stages, wherein each deployed plug defines a lower boundary of an associated stage, the deploying comprising:

deploying first plugs in the wellbore, the first plugs comprising a first material being reactive with a first agent and being not reactive with a second agent;

deploying second plugs in the wellbore, the second plugs comprising a second material not being reactive with the first agent and being reactive with the second agent;

alternating positions of the first and second plugs in the wellbore to cause the first plugs to establish lower boundaries for some of the stages and the second plugs to establish lower boundaries for at least some of the other stages;

performing stimulation operations in the plurality of stages;

communicating the first agent into the stages having lower boundaries established by the first plugs to react with the first material to remove the first plugs; and communicating the second agent into the stages having lower boundaries established by the second plugs to react with the second material to remove the second plugs.

16. The method of claim 15, wherein the act of communicating the first agent comprises communicating the first agent at or near conclusion of the stimulation operations in the stages in which the lower boundaries of the stages are established by the first plugs.

17. The method of claim 15, wherein the first agent comprises an acid, the first material comprises calcium carbonate, the second agent comprises a base, and the second material comprises a polyacrylic polymer.

18. The method of claim 15, further comprising:

perforating the wellbore in regions of the wellbore associated with the stages prior to the act of deploying the plugs.

19. The method of claim 15, further comprising:

communicating a hydraulic communication inhibiting agent into the wellbore near the conclusion of at least one of the stimulation operations.

20. The method of claim 15, further comprising:

using valves of the tubing string in the stages to perform the stimulation operations.

* * * * *